US005526097A

United States Patent [19]

Ream

[11] Patent Number: 5,526,097

[45] Date of Patent: Jun. 11, 1996

[54] CARTRIDGE UTILIZING A PLURALITY OF CONTACT CHARGING MEMBERS

[75] Inventor: Gregory L. Ream, Lexington, Ky.

[73] Assignee: Lexmark International, Inc., Greenwich, Conn.

[21] Appl. No.: 488,393

[22] Filed: Jun. 7, 1995

[51] Int. Cl.[6] ..... G03G 15/02

[52] U.S. Cl. ..... 355/219; 355/210

[58] Field of Search ..... 355/210, 200, 355/219, 227; 361/221, 225

[56] References Cited

U.S. PATENT DOCUMENTS

| | | | |
|---|---|---|---|
| 4,387,980 | 6/1983 | Ueno et al. | 355/219 |
| 5,017,964 | 5/1991 | Sadwick | 355/219 |
| 5,095,335 | 3/1992 | Watanabe et al. | 355/210 |
| 5,289,234 | 2/1994 | Asano et al. | 355/219 |
| 5,323,215 | 6/1994 | Ohtaka et al. | 355/219 X |
| 5,365,315 | 11/1994 | Baker et al. | 355/210 |
| 5,430,526 | 7/1995 | Ohkubo et al. | 355/211 |

*Primary Examiner*—Nestor R. Ramirez
*Attorney, Agent, or Firm*—John A. Brady

[57] ABSTRACT

Cartridge (1) contains a brush charger (32) and printer (40) contains a charge roller (30). Upon installation of the cartridge a top shutter (7) is moved downward and the charge roller is moved by a pivoted arm (44) through the opening left by the shutter to contact a photoconductor drum (24) in the cartridge. In operation the roller functions after charging by the brush at a potential to control the final charge on a photoconductor prior to xerographic imaging. The precharging by the brush greatly reduces deterioration of the charge roller, permitting long machine life with the accurate and uniform operation of a charge roller.

10 Claims, 4 Drawing Sheets

CARTRIDGE UTILIZING A PLURALITY OF CONTACT CHARGING MEMBERS

TECHNICAL FIELD

This invention relates to an electrophotographic imaging device employing a replaceable toner cartridge and contact charging.

BACKGROUND OF THE INVENTION

Replaceable toner cartridges are widely used in electrophotographic printers and copiers. Many such cartridges include the charging device, which may be a corona wire to generate ions or may be a charge roller or other contact charging member. The cartridges sold by the assignee of this invention for its Optra (trademark) and 4039 families of printers have a charge roller in the cartridge. Accordingly, that charge roller necessarily is replaced when the cartridge is replaced.

U.S. Pat. No. 5,365,315 to Baker et al, assigned to the assignee of this invention, locates its charge roller out of the cartridge, specifically in the lid, and thereby permits use of the same charge roller for the life of the machine. However, each charging operation entails some deterioration of the charge roller. With high printer usage and particularly with increased printing speeds, a single charge roller will not function for the life of the machine.

This invention places a charging device in the toner cartridge, but one which is a low-cost device suitable to charge the photoconductor to a level near the final charge required for printing. A charge roller in the printer or copier charges the precharged photoconductor to the final charge. Deterioration of the charge roller is greatly reduced such that the charge roller can last the life of a very heavy-duty printer (or other imaging apparatus).

U.S. Pat. No. 4,387,980 to Ueno et al discloses multiple, spaced contact charging members for the stated purpose of obtaining more uniform charging. This disclosure includes a three roller embodiment and a three brush embodiment. These are all commonly mounted in an imaging apparatus and not in a replaceable toner cartridge.

DISCLOSURE OF THE INVENTION

In accordance with this invention the greatly reduced deterioration of a charge roller charging to modestly above a precharge level is recognized and employed. A xerographic imaging apparatus in accordance with this invention has a replaceable toner cartridge and a charge roller mounted on a movable member. The cartridge also contains the photoconductor for the xerographic process and a low-cost contact charger, specifically a charging brush or cloth, to precharge the photoconductor.

In operation for imaging the cartridge is installed in the imaging device, and the charge roller is moved into contact with the photoconductor through a top opening created in the cartridge by pivoting of a top shutter. The voltage applied to the precharge member is slightly less or nominally identical with that of the charge roller, so that, when the precharged surface of the photoconductor reaches the charge roller, the charge roller defines the final charge on the photoconductor.

Since the final charge is applied by a roller, it is much more accurate and uniform than a charge applied by a brush or other known lower cost contact charging member. Low deterioration of the charge roller is experienced, permitting its use for a full machine life of a heavy-duty printer. The cartridge is replaced periodically when each cartridge is empty of toner which necessarily includes replacement of its low-cost contact charger.

BRIEF DESCRIPTION OF THE DRAWING

The details of this invention will be described in connection with the accompanying drawing, in which.

BEST MODE FOR CARRYING OUT THE INVENTION

Figure 1:
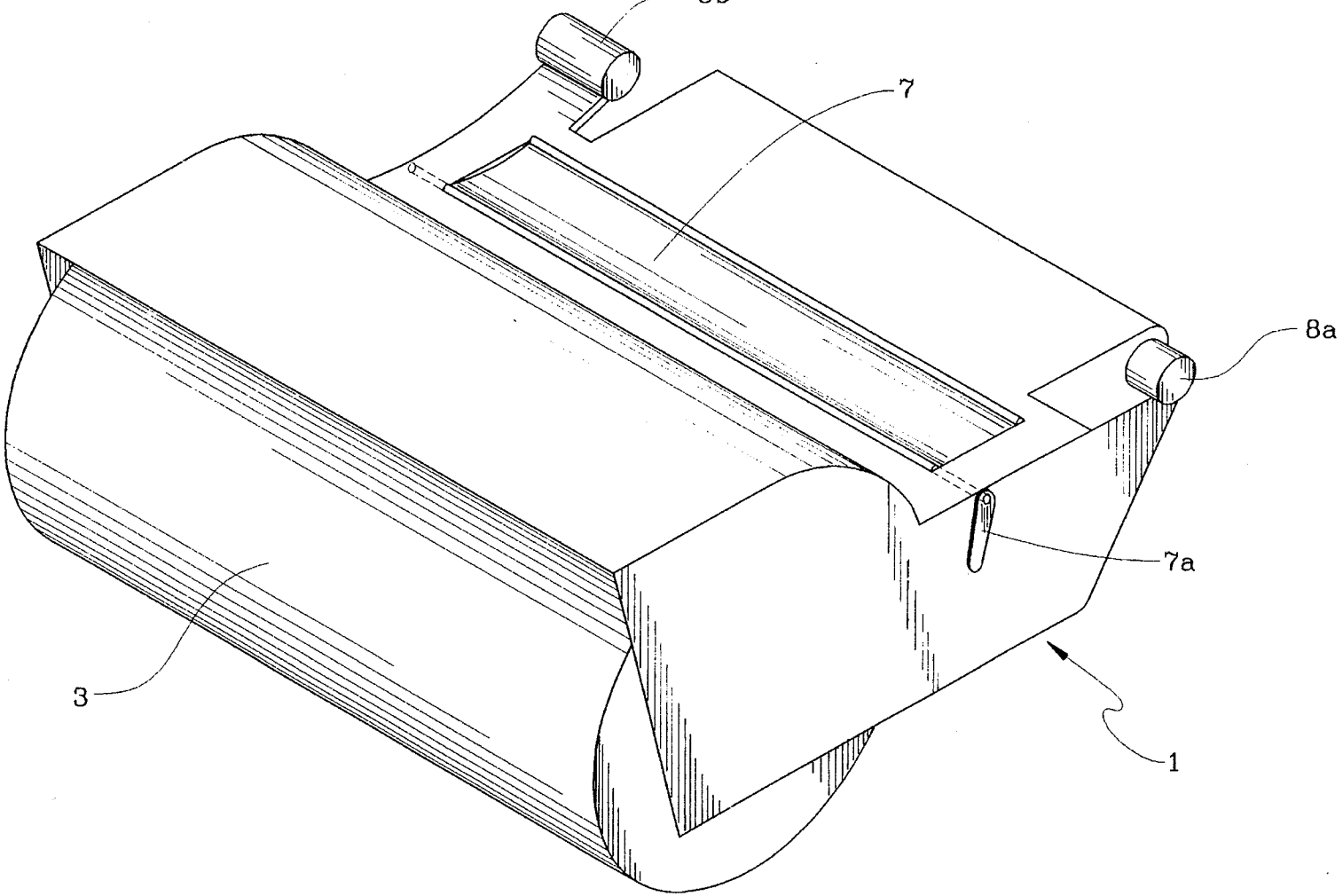
FIG. 1 is an illustrative perspective view of a replaceable toner cartridge, of the preferred embodiment.

Referring to FIG. 1, a toner cartridge 1 has a toner chamber 3 holding toner 5 (FIG. 2) and a top shutter 7, which rotates into cartridge 1 upon installation. Shutter 7 has a, control arm 7*a*, integral with shutter 7, which contacts an abutment 7*b* (FIG. 3) upon insertion of cartridge 1. Cartridge 1 has positioning studs. 8*a* and 8*b* on opposite sides for locating cartridge 1 when installed. A link 9 (FIG. 2) connects to a bottom shutter 11 to move bottom shutter 11 upon installation in the direction away from chamber 3. As is conventional, toner cartridge 1 is replaced with an identical cartridge 1 when toner 5 in a cartridge 1 is gone.

Figure 2:
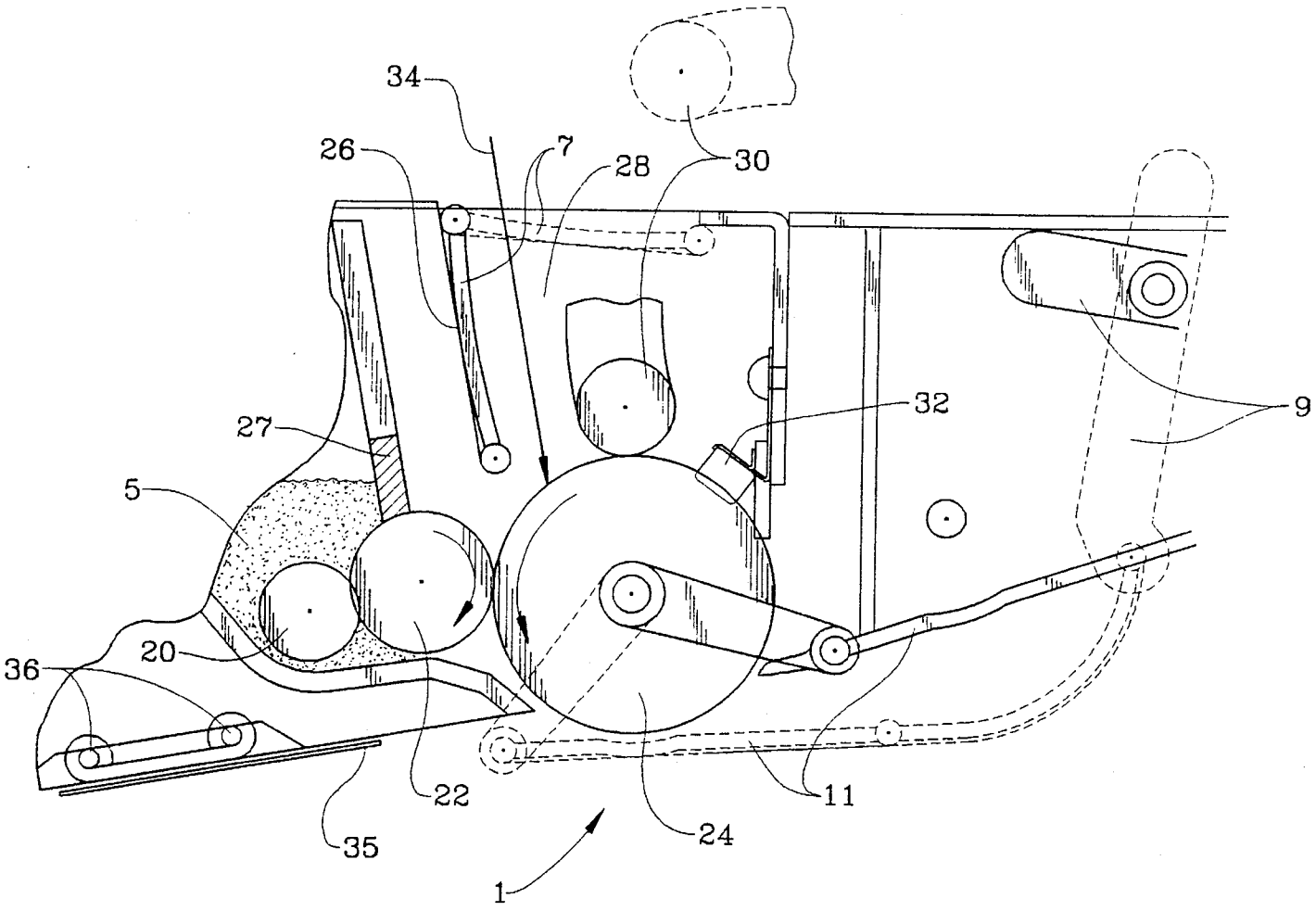
FIG. 2 is an illustrative, sectional view off the parts of the cartridge pertinent to this invention when installed in the printer of the preferred embodiment, as well as illustrating the charge roller entered into the cartridge and the optical path to the photoconductor.

FIG. 2 illustrates cartridge 1 as a installed and with the uninstalled positions of shutters 7 and 11 also shown in dashed outline. As is generally conventional toner 5 is agitated by a roller 20, termed a toner adder roller, and applied by a developer roller 22 to a photoconductor drum 24 (termed a drum because it is typically hollow). Toner 5 is metered by an electrified doctor blade 27 as it is moved to drum 24 by rotation of developer roller 22. (Arrows in the illustrations of roller 22 and drum 24 show the direction of rotation during operation).

Shutter 7 is rotated downward toward a surface 26 in cartridge 1, leaving an opening 28 above photoconductor 24. Charge roller 30 moves by pivoting as will be described from a position outside opening 28 (shown in dashed lines) to within the cartridge 1 will contact with the top of photoconductor 24 (shown in solid lines). Prior (with respect to the rotation of photoconductor 24 in imaging operating) to the location of contact of roller 30, a charge wiper or brush 32 is permanently mounted in cartridge 1 in charging contact with photoconductor 24. Arrow 34 shows a path to a location past the charging of photoconductor 24 by roller 30 at which the photoconductor 24 is discharged to form latent images, as is essentially conventional, which are developed with toner 5 applied by developer roller 22, as is also essentially conventional.

Charge roller 30 is preferably at least 12 mm in diameter, so the area past brush 32 under opening 28 must be unobstructed to permit roller 30 to enter opening 28 and contact drum 24 and to permit a clear optical path 34 for imaging after charging by roller 30.

To complete the imaging, paper or other substrate 35 is moved by feed rollers 36 nestled beneath cartridge 1, which move paper 35 into contact with photoconductor 24 at the area opened by the movement of shutter 11. The toner image is transferred to paper 35, as is conventional, and subsequent steps of fixing the image by heat and delivery of paper 35 may also be essentially conventional.

Figure 3:
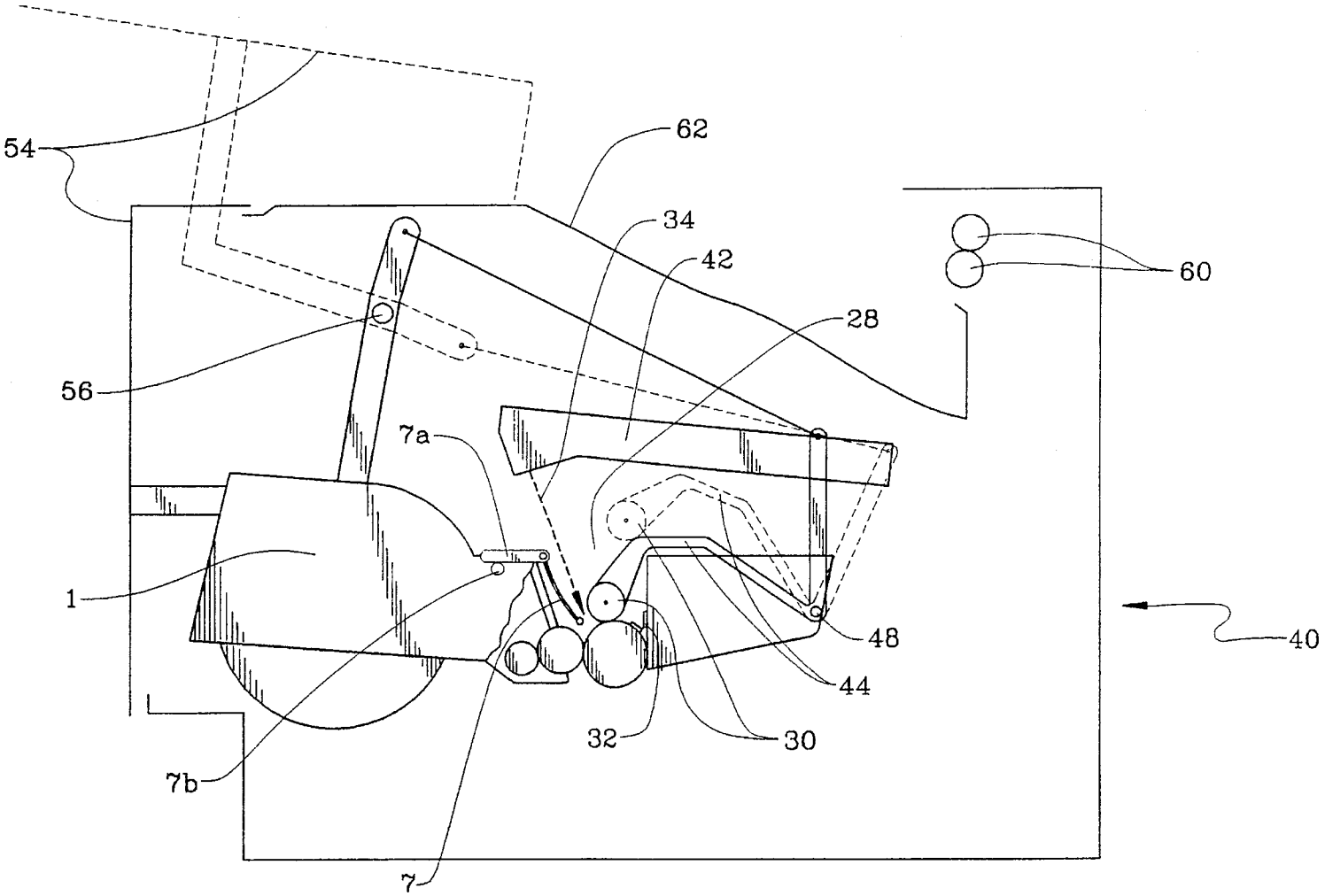
FIG. 3 is illustrative of the printer as a whole with particular detail of the charge roller mounted in the machine.

FIG. 3 illustrates a printer 40 with the cartridge 1 installed. Moveable parts are shown in solid line in the down position and dashed line in the up position. Light applied in the path of arrow 34 is generated by a laser printhead 42 which may be essentially conventional with respect to this invention. Charge roller 30 is mounted on arm 44, which is pivoted at a hinge 48. Front door 54 is rotated on hinge 56 upward (clockwise in FIG. 3) to provide room to insert and take out cartridge 1. Door 54 is pivoted upward on hinge 56 when cartridge 1 is inserted. Door 54 is then rotated downward to a closed position. When cartridge 1 is inserted control arm 7*a* encounters abutment 7*b* to pivot shutter 7 downward to create opening 28. At the same time charge roller 30 pivots through the opening 28 and into contact with photoconductor 24. Charge roller 30 is spring mounted (not shown) around pivot 48 to provide a constant force between charge roller 30 and photoconductor 24. Rollers 60 receive paper 35 having the final image and place it on output tray 62.

In operation charge brush 32 places a substantial portion of the required negative charging current onto photoconductor 24 prior to final charging by charge roller 24. Because brush 32 applies charge from strands, it produces a somewhat non-uniform charging pattern on the photoconductor 24 that would result in print quality pattern non-uniformity if used alone. However, in accordance with this invention, the surface of photoconductor 24 precharged by brush 32 subsequently reaches charge roller 30 and charge roller 30 deposits the final, uniform charge onto photoconductor 24.

The potential supplied to the brush 32 is −1400 volts, and the potential supplied to the charge roller 30 is −1600 volts. The aluminum core of photoconductor drum 24 is at −200 volts DC. Since the second voltage is larger than the first and of the same polarity, it dominates the final charge, and the charge roll 30 controls the uniformity and level of the final charge. The final surface charge on photoconductor 24 immediately after leaving roller 30 is very uniform at approximately −1040 volts.

To attain a 250,000 page life, the charge roller 30 has an uncoated or powder-coated epichlorohydrin resin body. The diameter is designed as relatively large (i.e., 12 or 15 mm, at least in the order of magnitude of 10 ram) to also increase life. Alternatively, the charge roller 30 can be coated with selected semiconductive material such as carbon-loaded Nylon® 6—6 to control final electrical characteristics, as is conventional.

Figure 4:
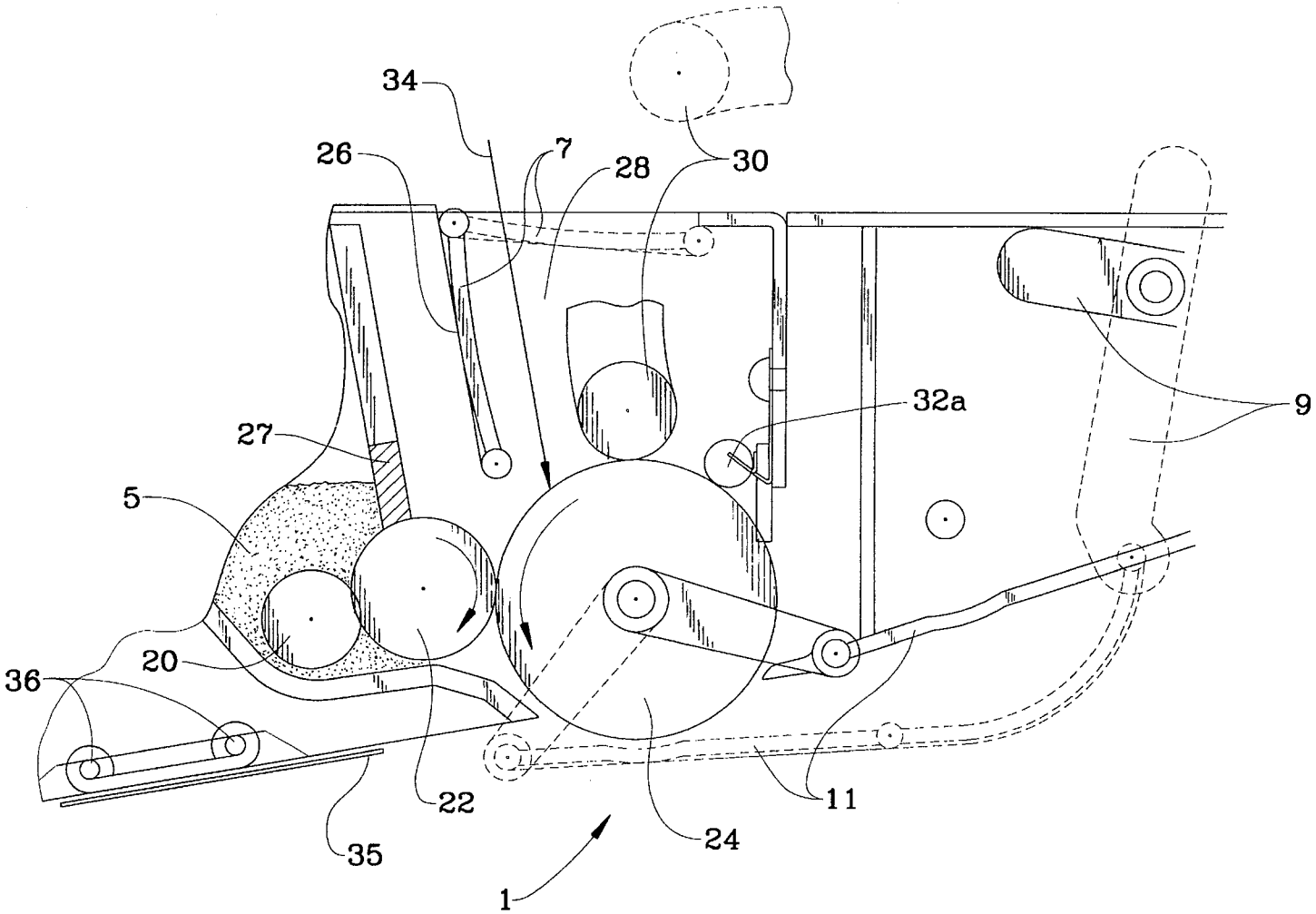
FIG. 4 is identical to FIG. 2 except that it shows a roller as the charging member in the cartridge.

The charge brush 32 is 4 mm conductive, carbon-loaded nylon fiber woven into a cloth of 60,000 to 250,000 fibers per square inch. This is commercially available as a contact charging member at relatively low cost. Any low cost contact charger is an alternative as the charge applied to photoconductor 24 need not be precise or uniform at this precharge location. A low cost charge roller 32*a* is illustrated in FIG. 4 as the cartridge-mounted charging member.

The foregoing printer 40 will operate with paper feed up to at least 5.4 inches per second, which can be considered 24 pages per minute. Printer 40 can function normally for 250,000 pages without replacing charge roller 30.

Variations will be apparent. Some charging systems apply AC and DC to the charge roller 30. In such a system, two alternatives are available, applying DC only to the charge brush 32 or applying combined AC and DC to both brush 32 and charge roller 30. Typical combined potentials for the charge roller 30 would be −1040 volts DC combined with 1500 volts peak to peak AC sine wave at 600 Hz, which achieves a final charge of −1040 volts. Where both the brush 32 and the charge roller 30 have combined AC and DC voltages, they would be identical.

What is claimed is:

1. An imaging apparatus operable for imaging when containing a replaceable cartridge containing a rotatable photoconductor, a first contact charging member to charge said photoconductor, toner, and a toner applicator to tone an electrostatic image on said photoconductor, said first contact charging member during an imaging operation charging said photoconductor to a first voltage level, said apparatus comprising a second charging member mounted on a movable member in said apparatus, said movable member when in an operating position of said apparatus locating said second charging member for charging said photoconductor operatively past the location of said first contact charging member, said second charging member charging said photoconductor to a second voltage of the same polarity as said first voltage at a level controlled by the voltage of said second charging member.

2. The imaging apparatus as in claim 1 with said cartridge contained in said apparatus for imaging operation of said apparatus.

3. The imaging apparatus as in claim 2 in which said first charging member is a wiper and said second charging member is a contact charging roller.

4. The imaging apparatus as in claim 3 in which said wiper is a cloth of woven filaments.

5. The imaging apparatus as in claim 3 in which said wiper is a low cost charge roller.

6. The imaging apparatus as in claim 1 in which said first charging member is a wiper and said second charging member is a contact charging roller.

7. The imaging apparatus as in claim 6 in which said wiper is a cloth of woven filaments.

8. The imaging apparatus as in claim 6 in which said wiper is a low cost charge roller.

9. A cartridge for an imaging apparatus comprising a rotatable photoconductor, toner, a toner applicator, a first contact charging member at a first charging position to charge said photoconductor, a shutter pivotable downward into said cartridge to leave an opening in said cartridge, said cartridge having a location downstream of said first charging position in the direction of rotation of said photoconductor which is unobstructed between said opening and said photoconductor to receive a second roller charging member of diameter of at least about 10 mm and to permit optical discharge at said photoconductor charged by said second charging member by a path through said opening.

10. The cartridge as in claim 9 in which said diameter of said charging roller is about 12 to about 15 mm.

* * * * *